US007743740B2

(12) United States Patent
Brown

(10) Patent No.: US 7,743,740 B2
(45) Date of Patent: Jun. 29, 2010

(54) AUTOMATIC BY-PASS SAFETY COOLING SYSTEM FOR FIRE PUMP ENGINES

(76) Inventor: Myron L. Brown, 265 Willis Rd., Taylors, SC (US) 29687

( * ) Notice: Subject to any disclaimer, the term of this patent is extended or adjusted under 35 U.S.C. 154(b) by 46 days.

(21) Appl. No.: 11/903,660

(22) Filed: Sep. 24, 2007

(65) Prior Publication Data

US 2008/0302317 A1 Dec. 11, 2008

Related U.S. Application Data

(63) Continuation-in-part of application No. 11/810,892, filed on Jun. 7, 2007, now Pat. No. 7,581,517.

(51) Int. Cl.
*F01P 7/14* (2006.01)

(52) U.S. Cl. ..... 123/41.09

(58) Field of Classification Search ..... 123/41.09, 123/41.55; 440/88 C, 88 D, 88 HE
See application file for complete search history.

(56) References Cited

U.S. PATENT DOCUMENTS

| | | | | |
|---|---|---|---|---|
| 2,715,394 | A | 8/1955 | Humpola et al. | |
| 3,242,914 | A * | 3/1966 | Benger, Sr. | 123/41.1 |
| 3,380,466 | A * | 4/1968 | Sarra | 137/115.16 |
| 3,522,150 | A * | 7/1970 | Galuska | 202/235 |
| 3,759,233 | A * | 9/1973 | Schlaffer et al. | 123/41.1 |
| 3,769,947 | A | 11/1973 | Crain | |
| 3,892,209 | A * | 7/1975 | Amiot | 123/41.29 |
| 4,284,127 | A * | 8/1981 | Collier et al. | 165/292 |
| 4,413,596 | A | 11/1983 | Hirayama | |
| 4,443,909 | A * | 4/1984 | Cameron | 15/320 |
| 4,461,342 | A | 7/1984 | Avrea | |
| 4,539,942 | A | 9/1985 | Kobayashi et al. | |
| 4,753,289 | A | 6/1988 | Avrea | |
| 4,790,369 | A | 12/1988 | Avrea | |
| 4,991,546 | A * | 2/1991 | Yoshimura | 123/41.31 |
| 5,004,042 | A * | 4/1991 | McMorries et al. | 165/41 |
| 5,101,775 | A | 4/1992 | Hubbs | |
| 5,211,136 | A | 5/1993 | Dacus et al. | |
| 5,599,217 | A * | 2/1997 | Ferrante | 440/88 R |
| 5,708,412 | A | 1/1998 | Proulx | |
| 5,718,373 | A | 2/1998 | Kim et al. | |
| 6,094,758 | A * | 8/2000 | Renfro | 5/118 |
| 6,109,346 | A * | 8/2000 | Hill | 165/297 |
| 6,298,809 | B1 | 10/2001 | Boggs | |
| 6,651,900 | B1 | 11/2003 | Yoshida | |
| 6,748,906 | B1 * | 6/2004 | White et al. | 123/41.01 |
| 7,048,044 | B2 * | 5/2006 | Ban et al. | 165/202 |
| 7,072,761 | B2 | 7/2006 | Hawkins et al. | |
| 7,168,398 | B2 | 1/2007 | Ap et al. | |

(Continued)

FOREIGN PATENT DOCUMENTS

| | | | |
|---|---|---|---|
| JP | 358013120 | A | 1/1983 |

(Continued)

*Primary Examiner*—Hai H Huynh
(74) *Attorney, Agent, or Firm*—McNair Law Firm, P.A.; William D. Lee, Jr.

(57) ABSTRACT

In an internal combustion engine system where the heat in the engine jacket coolant is discharged in a water cooled heat exchanger, an independent and automatic by-pass safety cooling system responsive solely and directly to engine jacket coolant temperatures to ensure that cooling of the engine will continue without reliance upon any other control system or personnel.

5 Claims, 3 Drawing Sheets

U.S. PATENT DOCUMENTS 7,264,520 B1 * 9/2007 Taylor et al. ..... 440/88 HE
7,370,611 B1 * 5/2008 White et al. ..... 123/41.01
7,398,745 B1 * 7/2008 White et al. ..... 123/41.01
7,421,983 B1 * 9/2008 Taylor ..... 123/41.01
2008/0302316 A1 * 12/2008 Brown ..... 123/41.02

FOREIGN PATENT DOCUMENTS

JP 401019112 A 1/1989

* cited by examiner

AUTOMATIC BY-PASS SAFETY COOLING SYSTEM FOR FIRE PUMP ENGINES

CROSS REFERENCE TO RELATED APPLICATION

This application is a continuation-in-part of U.S. application Ser. No. 11/810,892, filed Jun. 7, 2007 now U.S. Pat. No. 7,581,517 having the same title.

FIELD OF THE INVENTION

This invention relates to a safety by-pass system for providing cooling water to the heat exchanger which removes heat from the coolant of a diesel engine that drives a fire pump, the by-pass system being independent from the presently used fire pump controller and cooling loop controls. More particularly, the invention relates to a system that protects stationary fire pump installations at industrial facilities, office and commercial facilities, residential complexes, hospitals, airports, and large marinas by protecting the ability of a fire pump or sprinkler systems to continue to operate.

BACKGROUND OF THE INVENTION

Most large industrial plants, high rise office and residential buildings, airports, warehouse facilities, military installations, and educational institutions have sprinkler systems and fire pumps onsite which, in the event of a fire, provide large quantities of water for immediate response before offsite fire crews can reach the location of the fire. Typically, an internal combustion engine is installed in a pump house to drive a fire pump. The fire pump will draw its water from a municipal main, an onsite reservoir, or a storage tank. Fuel for the engine is stored adjacent to and dual redundant batteries are located within the pump house. The engine will have a cooling water jacket but being installed within a closed area the coolant is not routed through a radiator to be air cooled as in the case of a motor vehicle engine but, instead, is routed through a tube and shell heat exchanger where the coolant is in tubes that make a number of loops within the shell through which cooling water is circulating. The engine jacket coolant is normally an ethylene glycol/water mixture which gives the coolant a wide temperature range of operation without either boiling or freezing.

The cooling water for the shell side of the heat exchanger is normally tapped off the fire pump discharge and passes through a strainer, a pressure regulator, a water control solenoid valve, and an indicating manual valve before entering the heat exchanger. In a marine application the cooling water is sea water. Should a malfunction occur and the flow be interrupted, a manual by-pass system is provided to respond to engine overheating which will be indicated at the fire control panel in the pump house for the fire pump installation. However, if there is a wiring or circuit board problem in the fire pump controller panel, a strainer stoppage, a solenoid valve malfunction, or any of a number of possible malfunctions in the primary or manual by-pass system there are no further indicators or warnings after the by-pass system has been opened until the fire pump control panel in the pump house displays an alarm light which says "engine overheat". After the engine has overheated and run, only four to six minutes, which is enough time for the engine to destroy itself and then the "engine trouble" light comes on. In other words, the backup safety control is dependant on the integrity of the control panel and the immediate response by a qualified onsite maintenance person. If for some reason, and there can be many, the panel fails to function or if the manual by-pass system is not manually activated it will not operate, very quickly then destructive overheating of the engine will occur.

There are two major reasons why such malfunctions causing an overheat situation are now more likely to occur. First, in today's world with pressure on reducing costs, unfortunately, one of the first places that costs are reduced is in maintenance and, particularly, in the maintenance of equipment that goes unnoticed until there is an emergency. Quite often, because of reduced staff, or, if no staff is available, it is difficult to ensure that the periodically required maintenance that should be performed for a fire system is actually done. Thus it happens that fire control panels, valves, wiring, test runs and indicators are not regularly inspected on the timely basis that they should. The second reason, which is connected to the first, is that in an emergency when the engine starts up and begins to run there is usually no one continuously monitoring the control panels in the pump house as the maintenance staff personnel, that may or may not be onsite, are usually thinly stretched and are attending to what will appear to be the more important aspects of the emergency. However, should the fire pump engine fail, not only is there no water to fight the fire, the sprinkler and other systems will be jeopardized also. Severe injuries, loss of life, and loss of assets can be the tragic result as well as down time and very expensive replacement costs of equipment.

Accordingly, it is a general object of the present invention to provide a practical, automatic, redundant backup system that is independent of the fire pump controller and that will ensure that an engine does not overheat and destroy itself.

In marine installations the power and propulsion systems are virtually always diesel engines. While the marine diesels are cooled in a manner similar to the above described installation with the engine jacket coolant being circulated through a tube and shell heat exchanger, the coolant water is raw sea water or lake water pumped directly into the heat exchange. However, marine installations need safety by-pass systems just as the land based application mentioned above and it is another object of the present invention to provide such a system for marine applications.

The foregoing and other objects of the present invention are achieved by my invention which is described in more detail below.

SUMMARY OF THE INVENTION

To achieve the above mentioned objects it has been surprisingly discovered that by providing an independent and automatic by-pass safety cooling system that is responsive solely and directly to the engine jacket coolant temperature that continued cooling of the engine will occur without reliance upon any other control systems, panels, or personnel. In a stationary installation, the engine, once started, will continue to run; and; since the engine jacket coolant pump is built into the engine, as long as the engine is running, the jacket coolant will be circulating. However, the problem is to insure continued cooling water to the heat exchanger that cools the engine jacket coolant. This is solved by the redundant back up system of the present invention.

Accordingly, in one aspect the present invention is a novel automatic by-pass safety cooling system which includes valve means connecting an independent water supply to said heat exchanger. The independent water supply is the supply to the fire pump which may come from a municipal system, tank, or a reservoir. The system further includes a temperature sensing means or sensor located in the engine jacket for detecting the temperature of the engine jacket coolant and means responsive to said temperature sensing means to automatically open said valve through a recording hour meter means at a pre-set temperature level thereby delivering water from the independent supply to the heat exchanger, said valve means being solely and directly actuated by the sensing means. Preferably, the system includes a water pressure control means and a preferred first pre-set temperature level which is preferably about 185° F. The system also preferably includes a recording meter that will record the jacket operating temperature history. A second sensor independent from the first is preferably included in the jacket and is set at a higher and second temperature level, preferably about 205° F. This second system is also provided with a recording meter.

In another aspect, the invention is an automatic safety cooling system for a stationary internal combustion engine installation or for a marine installation, which may include generator sets and/or propulsion engines, said engines having a cooling jacket through which a primary coolant circulates, said system comprising a metal by-pass block or housing having a generally rectangular configuration and having a centrally located water supply channel longitudinally extending through the block; the channel having a water inlet at one end of said block and a water outlet at the other; and, in stationary installation two additional passageways are formed in said block, each passageway being generally parallel to and in communication with the channel through valve means at each end thereof, each passageway respectively having a pressure gauge, strainer, pressure regulator, and solenoid valve operatively associated therewith, one passageway being designated the automatic by-pass channel and the other being designated the primary cooling passageway; a control panel located on the top side of said block; sensing means associated with said engine jacket for detecting the temperature of said coolant; switch means in communication with said sensing means and being responsive to pre-set temperature levels; a manually operated primary coolant solenoid valve for controlling the opening and closing of the primary cooling passageway and for diverting water flow to said channel; and, an automatic solenoid valve solely responsive to the by-pass block control panel switch means at pre-set levels to open flow through said automatic by-pass channel. The metal of the by-pass block is preferably aluminum or an aluminum alloy and may also be brass, nickel alloy, bronze, a stainless steel or other corrosion resistant metal or metal alloy.

In still a further aspect the present invention is an automatic by-pass safety system for a diesel engine where the engine jacket coolant is circulated through a water cooled heat exchanger to discharge its heat comprising: a housing of non-corrosive metal selected from the group consisting of aluminum, aluminum alloys, brass, bronze, and stainless steel; said housing being substantially rectangular; said housing having a central by-pass channel extending longitudinally therethrough and having openings on opposed faces of the housing, one opening being an inlet and the other an outlet; spaced apart first and second valves in said channel, each valve being opened and closed by a solenoid; said housing having a primary cooling water passageway extending within said housing generally parallel to said channel, said primary passageway connecting to said channel at one end between the first valve and the inlet and at its other end to the channel between the second valve and the outlet; third and fourth spaced apart valves in said primary passageway, said valves being solenoid driven; said housing including a safety by-pass passageway, said safety passageway being generally parallel to said channel and being connected at one end to the channel at a point between the first valve and the inlet and at its other end to the channel at a point between the second valve and the outlet; fifth and sixth spaced apart valves disposed in said safety channel, each of said valves being opened and closed by a solenoid; first and second recording meters mounted on the outside of said housing; first and second temperature sensors positioned in said engine jacket to sense the temperature of the coolant circulating therein; said sensors being operably connected to said meters to actuate the first meter when a first temperature level is reached and to actuate the second meter when a second temperature level is reached; and said meters being operably connected to the solenoid of the fourth valve which is located in the safety by-pass passageway to open said fourth valve therein upon receipt by the solenoid of its respective signal.

DESCRIPTION OF THE DRAWINGS

Attached hereto and made a part of this specification are the drawings which are presented by a way of illustration and not by way of limitation. In the drawings.

DETAILED DESCRIPTION

Figures 3, 4:
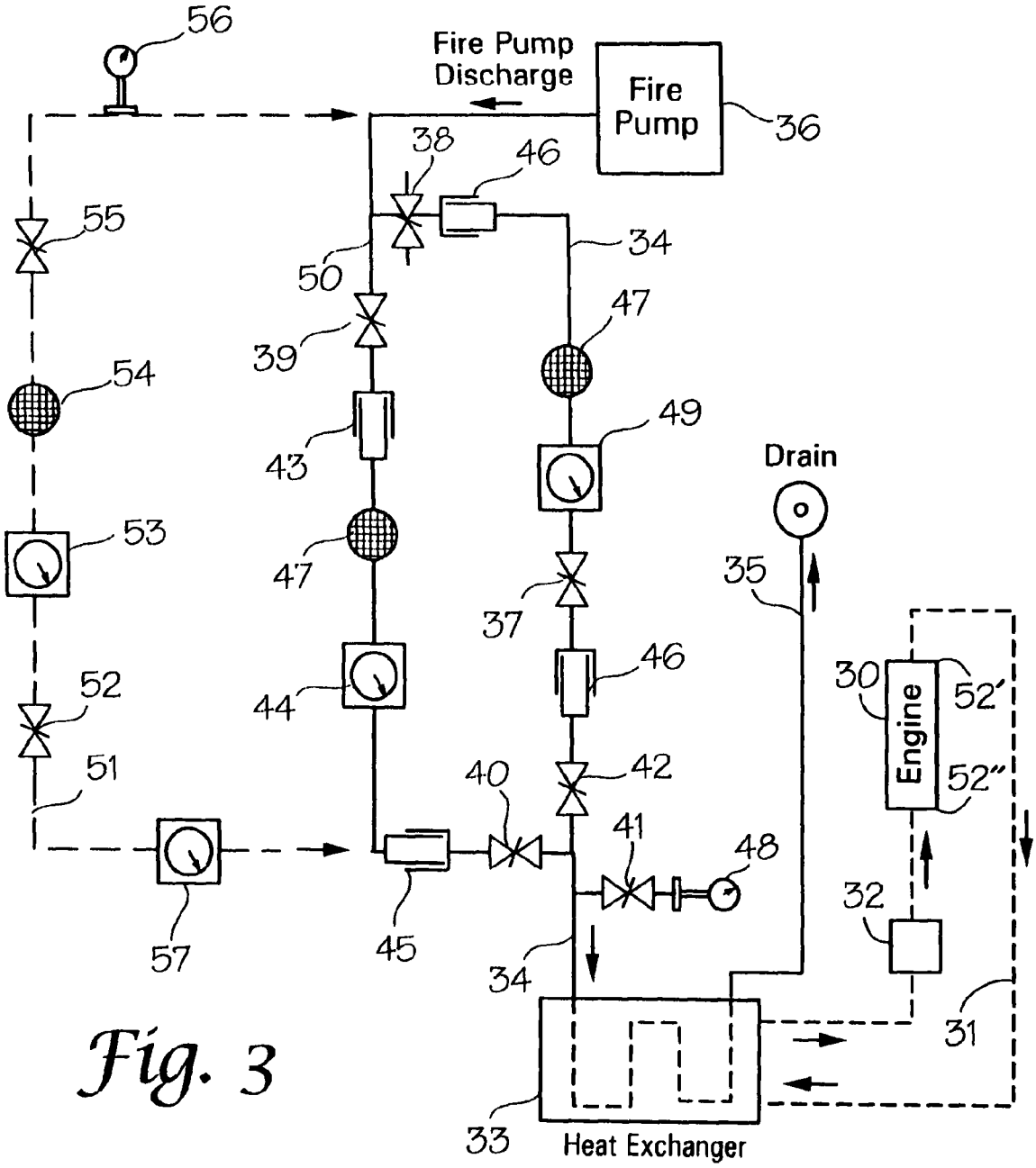
FIG. 3 is a schematic representation of the automatic by-pass safety cooling system of the present invention as it may be connected to the cooling loop system of FIG. 3.
FIG. 4 is a schematic representation of a standard cooling loop and a fire pump with a controller for actuating the automatic primary water source solenoid valve.

Looking first at FIG. 4, a standard cooling loop layout is schematically shown, FIG. 3 being the left hand side of the sheet displaying FIGS. 3 and 4. Such a layout may be found in the NFPA Engine Driven Fire Pump Manual. In FIG. 4, engine 30 is represented with a cooling pump 32 which is driven directly from the engine and is built into the engine. The cooling loop contains the engine coolant which generally will be an ethylene glycol/water mixture and the coolant circulates through the water cooled tube and shell heat exchanger 33 where its heat is discharged. As the coolant is circulated in coolant tubes inside the heat exchanger water from the primary water supply line 34 which is water shunted or tapped off the discharge from the fire pump 36 as it is being driven by the engine. This water circulates around the coolant tubes and is dumped down the drain 35 rather than being recirculated.

The fire pump 36 may supply water directly to fire hoses to put out fires and also may provide additional sprinkler system water. Usually this source of water is from the municipal water supply and, as the fire pump is turned on in response to an emergency, the automatic valve 37 is opened. Indicating valves 38 and 42 are to be open at all times so that when the fire pump begins operation and is driven by the engine, the automatic valve 37 opens by a signal from the fire control panel so that water will flow through the line 34 to the heat exchanger 33. The water that flows though valve 38 at this time has also traveled through union 46, strainer 47, through indicating manual valve 42 and then into the heat exchanger 33.

The fire pump includes a control panel that will show the temperature of the engine from a sensor in the engine cooling jacket. Should the engine begin to overheat, a warning light appears on the control panel associated with the fire pump to alert an operator, if present, to open the valve 39 so that water can flow in the manual by-pass line 50 through union 43, strainer 47, pressure regulator 44 and through union 45. The indicating manual valve 40 usually remains open at all times except when needed to isolate the line 50 for maintenance. However, should the control panel warning light not operate and indicate that the engine is running hot or should there be a power failure to the control panel or other malfunction, or should the operator be called to perform another task during an emergency and not observe the warning light, the engine will simply continue to run and become more and more overheated until it seizes thus causing a total failure of the engine pump, and/or sprinklers. This scenario is even more likely to happen in today's economic climate where the number of maintenance personnel is constantly being reduced, or at times when maintenance personnel are not present on the premises. Maintenance personnel have more and more tasks to perform and required maintenance procedures are likely to be skipped or delayed. The possibility of a failure in the control panel or in any one of the components in the line would fail is becoming significantly increased.

Looking now at FIG. 3, one embodiment of the automatic by-pass safety cooling system of the present invention is shown in a schematic representation. To describe this embodiment, references are made to FIG. 3. Temperature sensing means 52' and 52" are located in the engine jacket for detecting the temperature of the engine coolant. Should a malfunction occur in the primary water supply line 34 so that water does not come through the primary line in which automatic valve 37 is located and, for some reason the valve 39 in the manual by-pass line 50 is not operated immediately by a maintenance person or one of the other components has failed or impedes flow, then none or very little water will reach the heat exchanger 33. As a consequence, the temperature will begin to rise because of the failure of non-existent primary water flow through either the primary line or through the manual by-pass line. The temperature increase will be detected by sensing means 52' (185° F.) and will send a signal to the first recording hour meter 6 (See FIG. 1 and $R_1$) then to the solenoid valve 52 to open the valve. The manual valve 55 is always open except for maintenance. The valve 52 is preferably a solenoid driven 12 or 24 v D.C. valve but other means may be used such as intermittent drive electric motor. The sensing means of 52' is part of an independent system on the engine which comprises the sensing means, a redundant 12 volt or 24 volt storage battery, and the switch connections including recording meter $R_1$ to the solenoid driven valve 52 whereby the solenoid will have independent and sufficient power to open the valve 52. Preferably, this first sensing means is set to actuate the solenoid when the temperature of the engine coolant reaches 185° F. This first temperature level can be increased or decreased as desired.

The second sensing means 52" is equipped with the second battery and likewise is connected to a second hour meter ($R_2$ in FIG. 1) and then to the solenoid 52 so that it will always have sufficient power to open the valve by means of the solenoid. The temperature level at which this sensing means is set is preferably 205° F.

Best Mode

Figure 1:
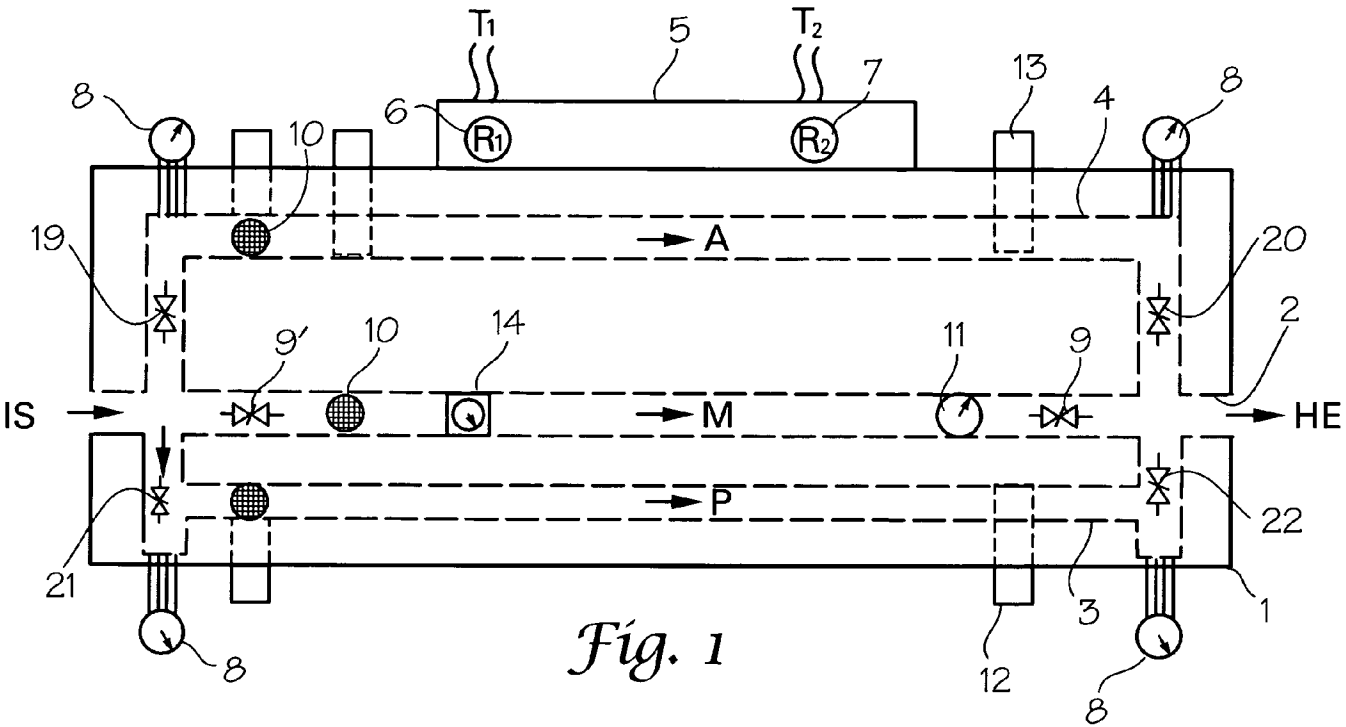
FIG. 1 is a perspective side view of a schematic representation of the by-pass block according to the present invention.
Figure 2:
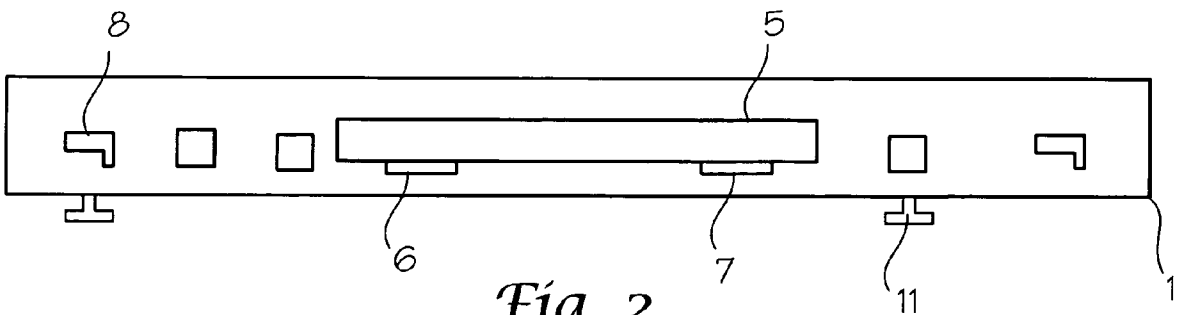
FIG. 2 is a top view of the by-pass block as shown in FIG. 1.

Turning now to FIG. 1 the unique and novel best mode of the present invention will be described. In this figure, metal housing or block 1 is shown in a side view. In FIG. 2 the top view of this block is shown. The block is approximately 20 inches long, 12 inches high, and 4 inches wide. The block is preferably aluminum or an aluminum alloy although stainless steel, brass, or bronze could be used but they are relatively expensive. In general, any corrosion resistant metal could be used. A central channel 2 or M is drilled longitudinally and has a 1½ inch diameter. Parallel passageway 3 or P which is the primary cooling passageway and passageway 4 or A which is the automatic by-pass passageway are also drilled and plugged appropriately at their ends and connect with cross channels that accommodate the pressure gauges 8. These channels are appropriately plugged and threaded to accommodate the instrumentation and components and to achieve the flow pattern shown. Indicating manual valves 9 (FIG. 1) remain open when the system is installed except that valve 9' is closed. The usual components of a strainer 10 and gauge 11 are also shown. The positions of the gauge and valves may be changed to other locations as necessary or required but, as shown, first and second valves 9' and 9 are located in the manual operated by-pass channel 2 through which water flows in direction M, third and fourth valves 19, 20 are located in safety by-pass passageway 4 with flow direction A, and fifth and sixth valves 21, 22 are located in the passageway 3 with flow direction P. The first, third and fifth valves are located adjacent the inlet or IS side of the housing in their respective passageways or channel and the second, fourth and sixth valves are located in their respective channel or passageway adjacent the outlet or HE side of the housing. A control panel 5 is affixed to the top of the block and it carries the hour meter 6 ($R_1$) and 7 ($R_2$) which are actuated by sensors 52' and 52" respectively which are located in the engine block for the two temperature levels T1 (185°) and T2 (205°).

The block 1 may be located adjacent to the engine or on the engine itself. In operation, when the engine is started and the fire pump actuated, primary water will flow in the primary coolant passageway 3 in the direction of the arrow P when the solenoid 12 is actuated. (This corresponds to the valve 37 in FIG. 3.) Should elevated engine temperature be indicated on the fire pump panel, the maintenance person will open the manual indicating or first valve 9 (Same as valve 39 in FIG. 3) and water will flow from the independent source IS in the direction of arrow M towards the outlet and to heat exchanger HE. However, if flow M does not begin through channel 2 or, after having begun, and for some reason water flow fails or becomes inadequate so as not to be feeding sufficient cooling water to the heat exchanger, then the temperature in the engine jacket coolant will begin to increase and when it reaches 185° F. a signal is sent to hour meter 6 to actuate the solenoid 13 and open the valve associated therewith so that water will flow through the automatic by-pass loop. This operation takes place directly in response to the signal sent from the sensor in the engine jacket coolant and the signal is not dependent upon any action by an operator or maintenance person or from any signal from any other control panel. This ensures that at all times during the operation of the engine there is water from the primary source going to the heat exchanger so that the engine remains at a safe operating temperature. Should, for some reason, the first sensor 52' not operate properly, or at all, then the temperature will continue to increase until it has reached the 205° F. level at which time the second sensor 52" will send a signal to the second hour meter 7 ($R_2$) which will then actuate the solenoid 13 to open the valve in the automatic by-pass passageway. In this manner the primary water source is always available to cool the coolant in the heat exchanger and prevent engine breakdown from excessive heat.

Figure 5:
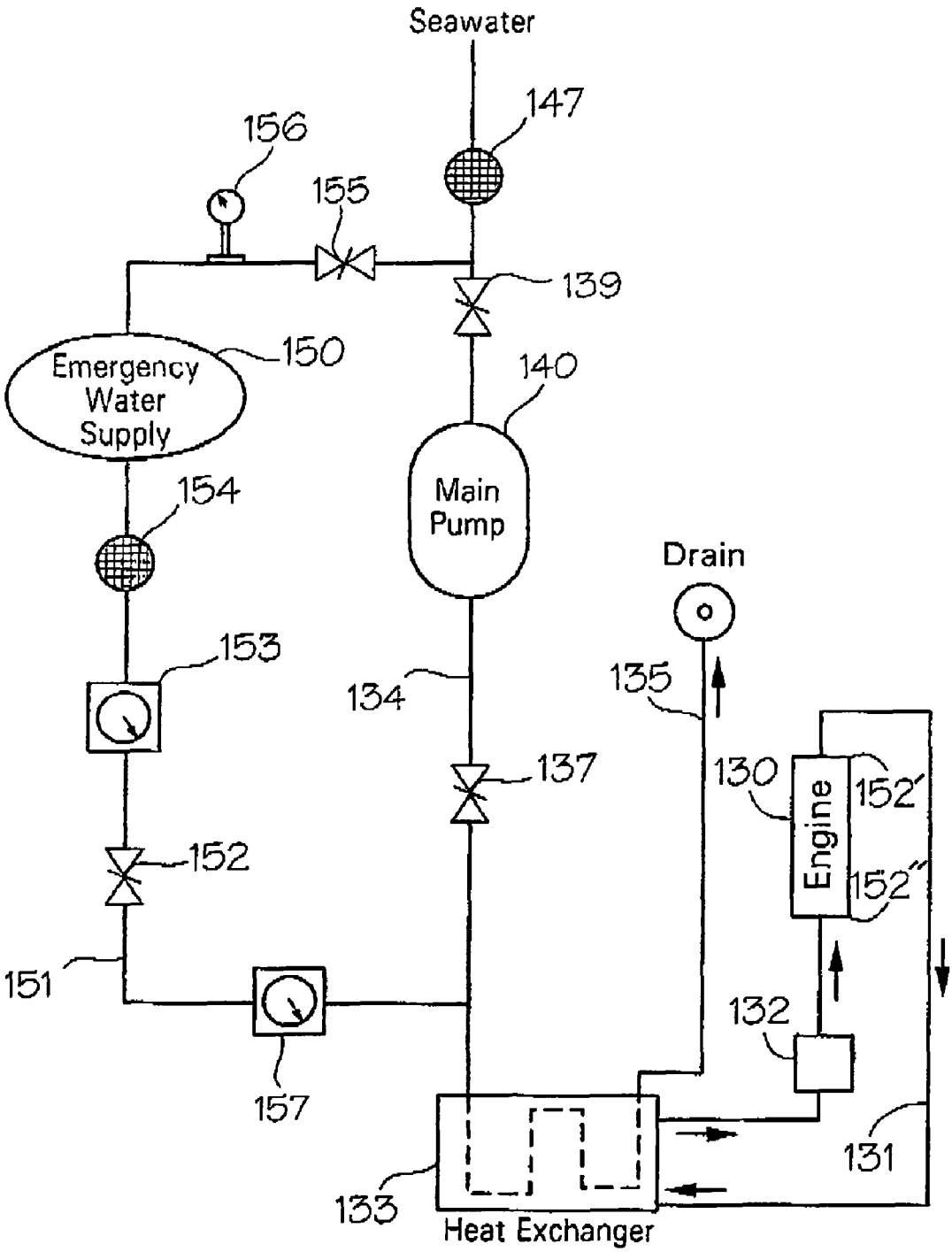
FIG. 5 is a schematic representation of a by-pass safety system for a marine installation.

The foregoing by-pass system as described herein is primarily designed for stationary installation where the coolant is cooled by liquid in a heat exchanger rather than being fed through a radiator and cooled by air. This by-pass safety system can also be employed in marine installations which generally are diesel driven and propulsion engines. Looking at FIG. 5, a preferred marine application will be described. The engine jacket coolant circulates in line 131 moving the coolant by means of pump 132 from jacket 140 which surrounds the engine block to the heat exchanger 133 which is a tube and shell exchanger. Sea water is pumped in line 134 through strainer 147 by main pump 130 through control valve 133 where it circulates within the heat exchanger and exits through line 135 to the engine exhaust. Should the main pump 140 fail or line 134 become clogged and then any increase in coolant will be first detected by sensor 152' when the temperature reaches the preferred first pre-set level of 185° F. The sensor will then signal a first recording hour meter such as $R_1$ in FIG. 1 to close valves 137 and 139 and shut off power to main pump 140 while opening valves 152 and actuating the emergency water supply. If the emergency water is to be drawn from the sea, then valve 155 will be opened. If the emergency water is to be drawn from the ship's fresh water supply then valve 155 will remain closed. In either event an independent supply of water is presented. if the engine jacket temperature continues to increase then at 205° F. sensor 152' will send a signal to a second recording hour meter such as $R_2$ in FIG. 1 to repeat the sequence mentioned above. In both instances, the emergency by-pass system comprising the line 151 supply 150, valve 152, meter 153, strainer 154, valve 155, recorder 156, and meter 157. This by-pass system is actuated independently of any operator control panel, or other system so that cooling water will always be sent to the heat exchanger. The engine 130 may drive the main pump and also a fire pump in addition to being the propulsion drive.

While the automatic by-pass safety system of my invention is redundant, the need for such a system increases as the number of lives and the value of assets protected becomes greater and maintenance of fire fighting systems become less. Thus, all reasonable precautions need to be taken to be assured that life and property are protected. The relatively low cost and high reliability of my invention justifies its installation and use.

After reading the foregoing description and viewing the accompanying drawings, other embodiments of my invention may become apparent to those skilled in the art but the scope of my invention is limited only by the claims which follow.

What is claimed is:

1. An automatic by-pass safety cooling system for a liquid cooled stationary internal combustion engine or for marine application of internal combustion engines, said engine having a primary cooling system including an engine jacket, a water cooled heat exchanger, coolant circulating between the jacket and the heat exchanger, and an independent supply of water to remove heat from the heat exchanger; said automatic by-pass safety cooling system comprising:

a) valve means connecting said independent water supply to said heat exchanger;

b) temperature sensing means located in said engine jacket for detecting the temperature of the engine coolant; and, c) control means for adjusting the pressure in said independent water system from 20 psi to 150 psi;

d) solenoid drive means responsive to said temperature sensing means to automatically open said valve means at a pre-set temperature level thereby delivering water from the independent supply to said heat exchanger, said valve means being solely and directly actuated by said sensing means.

2. The system of claim 1 wherein the temperature sensor means is a first sensing means with a first pre-set temperature level and, including a first battery associate with said first sensing means to actuate the drive means.

3. The system of claim 2 including a second temperature sensing means pre-set at a second and higher temperature than the first; and including a second battery associated with said second temperature sensing means.

4. The system of claim 1 including a recording meter associated with said sensing means whereby recording meter actuates the drive means and the jacket temperature history can be monitored when the solenoid valve is actuated.

5. An automatic by-pass safety system for a diesel engine where the engine jacket coolant is circulated through a water cooled heat exchanger to discharge its heat comprising:

a) a housing of non-corrosive metal selected from the group consisting of aluminum, aluminum alloys, brass, bronze, and stainless steel; said housing being substantially rectangular;

b) said housing having a central by-pass channel extending longitudinally therethrough and having openings on opposed faces of the housing, one opening being an inlet and the other an outlet;

c) spaced apart first and second valves in said channel, each valve being opened and closed by a solenoid;

d) said housing having a primary cooling water passageway extending within said housing generally parallel to said channel, said primary passageway connecting to said channel at one end between the first valve and the inlet and at its other end to the channel between the second valve and the outlet;

e) third and fourth spaced apart valves in said primary passageway, said valves being solenoid driven;

f) said housing including a safety by-pass passageway, said safety passageway being generally parallel to said channel and being connected at one end to the channel at a point between the first valve and the inlet and at its other end to the channel at a point between the second valve and the outlet;

g) fifth and sixth spaced apart valves disposed in said safety channel, each of said valves being opened and closed by a solenoid;

h) first and second recording meters mounted on the outside of said housing;

i) first and second temperature sensors positioned in said engine jacket to sense the temperature of the coolant circulating therein; said sensors being operably connected to said meters to actuate the first meter when a first temperature level is reached and to actuate the second meter when a second temperature level is reached; and said meters being operably connected to the solenoids of the fourth valve in the safety passageway to open said fourth valve therein upon receipt by the solenoid of its respective signal.

* * * * *